United States Patent [19]

Seitz

[11] 4,287,865

[45] Sep. 8, 1981

[54] CLOSED LOOP ENGINE CONTROL SYSTEM

[75] Inventor: William R. Seitz, Farmington, Mich.

[73] Assignee: The Bendix Corporation, Southfield, Mich.

[21] Appl. No.: 290,188

[22] Filed: Sep. 18, 1972

[51] Int. Cl.[3] ..... F02B 3/00

[52] U.S. Cl. ..... 123/489

[58] Field of Search ..... 123/119 R, 32 EA

[56] References Cited

U.S. PATENT DOCUMENTS

| | | | |
|---|---|---|---|
| 3,548,792 | 12/1970 | Palmer | 123/32 EA |
| 3,548,795 | 12/1970 | Howland | 123/119 R |
| 3,610,212 | 10/1971 | Endo | 123/32 EA |
| 3,616,274 | 10/1971 | Eddy | 123/119 R |
| 3,636,931 | 1/1972 | Suda | 123/32 EA |
| 3,676,782 | 7/1972 | Lane et al. | 307/229 |
| 3,707,950 | 1/1973 | Schlimme | 123/32 EA |
| 3,782,347 | 1/1974 | Schmidt et al. | 123/32 EA |
| 3,815,561 | 6/1974 | Seitz | 123/32 EA |
| 3,875,907 | 4/1975 | Wessel et al. | 123/119 EC |

FOREIGN PATENT DOCUMENTS

| | | | |
|---|---|---|---|
| 600895 | 4/1928 | United Kingdom | 60/276 |

*Primary Examiner*—Ronald B. Cox
*Attorney, Agent, or Firm*—Gaylord P. Haas, Jr.

[57] ABSTRACT

A closed loop engine control system for internal combustion engines is described. The control system includes a comparator which is responsive to signals indicative of the presence or absence of oxygen in the exhaust gas of the engine and a set point or reference and is operative to generate an output signal for receipt by a fuel delivery controller which will cause that fuel delivery controller to increase fuel delivery in the presence of oxygen molecules in the exhaust gas and to decrease fuel delivery in the absence of oxygen molecules in the exhaust gas in order to maintain the fuel delivery at the predetermined, and preferably the stoichiometric, air/fuel ratio mixture point. An oscillatory stabilization signal is also applied to the comparator to reduce the amplitude of the limit cycle. The frequency of the stabilization signal should be slightly above the band pass frequency of the closed loop and the amplitude of the signal should be less than the minimum deviation expected between the sensor output signal and the set point level for square wave stabilization signals.

19 Claims, 8 Drawing Figures

FIG. 1
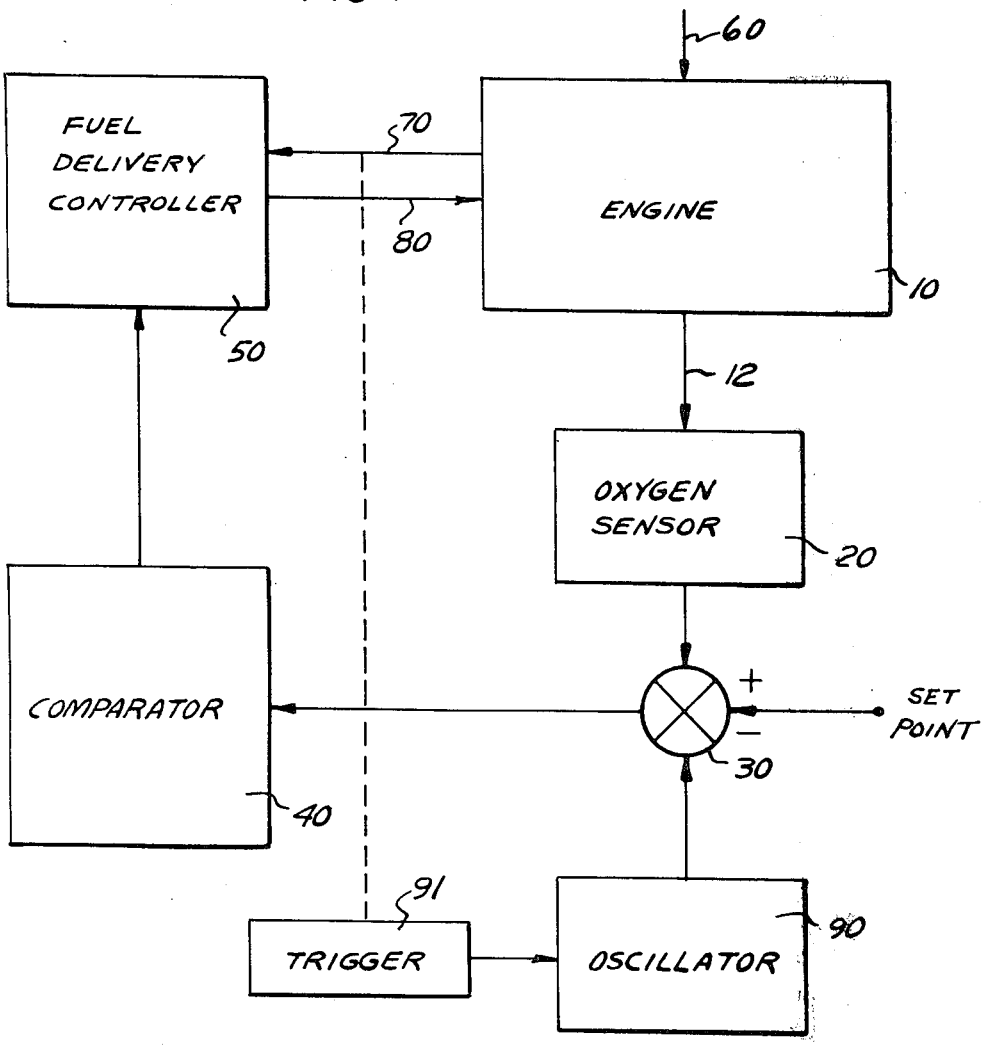
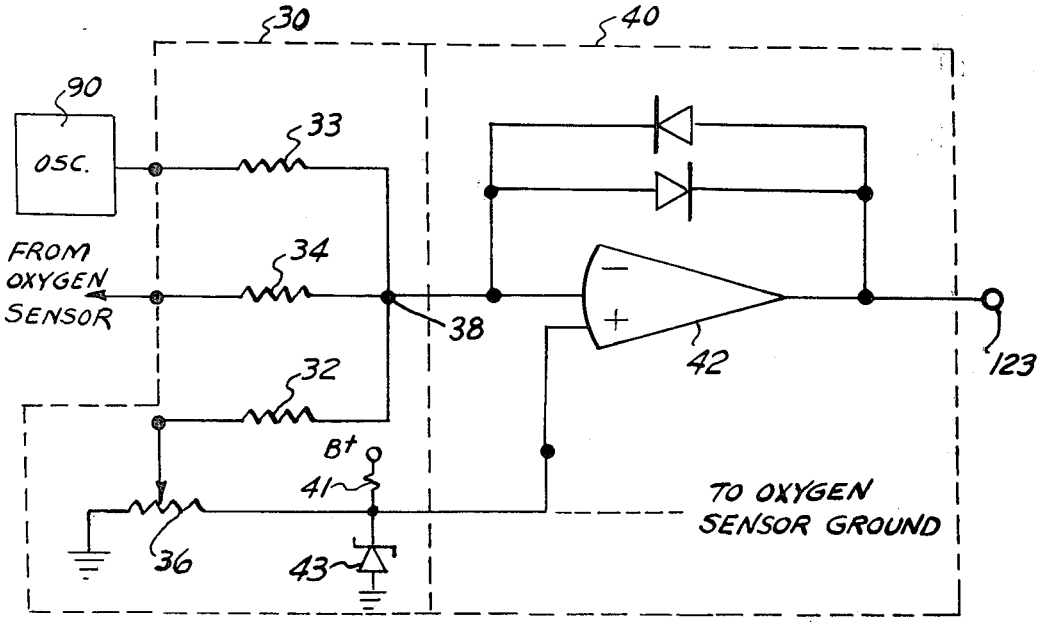
FIG. 2

SENSOR VOLTAGE SIGNAL
1.0v
0.5v
0.2v
1
2
3
TRANSITIONAL BAND
STOICHOMETRIC
AIR/FUEL RATIO

COMPARATOR OUTPUT SIGNAL
+.7v
0
-.7v
$t_1$
t

CAPACITOR VOLTAGE
a
b
c
d
e
f
4a
4
4b
5
$t_1$
$t_2$
$t_3$
$t_4$
t $t_1$
$t_2$
$t_3$
$t_4$
t
FREE DELIVERY COMMAND PULSES

EFFECTIVE COMPARATOR OUTPUT
7
8
6
ERROR SIGNAL

CLOSED LOOP ENGINE CONTROL SYSTEM

CROSS REFERENCE TO RELATED APPLICATION

This application is related to my co-pending commonly assigned U.S. Pat. No. 3,815,561 and titled "Closed Loop Engine Control".

BACKGROUND OF THE INVENTION

1. Field Of The Invention

The present invention is related to the field of variable volume combustion chamber internal combustion engine control systems in general and in particular to that portion of the above noted field concerned with closed loop control system. In greater detail, the present invention is concerned with a closed loop control system in which the exhaust gases of an internal combustion engine are analyzed to indicate the ratio of the air/fuel mixture being consumed by the engine and through which signals are generated in order to modulate the fuel delivery mechanism in order to provide a predetermined air/fuel ratio mixture for the engine.

2. Description Of The Prior Art

The prior art, particularly as defined by my co-pending commonly assigned patent application Ser. No. 289,200, filed Sept. 14, 1972 and issued on June 11, 1974 as U.S. Pat. No. 3,815,561, expressly incorporated herein by reference, provided for the application of an output signal from an engine combustion quality sensor to a summing point which would compare this signal with an established reference signal to drive a comparator to switch between established high and low limits which limits were not effected by the temperature environment of the sensor or the age of the sensor. The comparator signal was then applied to a fuel delivery controller to modulate fuel delivery. However, in applying this system to the fuel control mechanism of an internal combustion engine it was found that the engine exhibited an oscillatory or limit cycling type of operation due to the hard nonlinearity of the comparator in the system. The frequency of oscillation depended upon the dynamics of the engine and was normally a small fraction of the triggering frequency of the associated fuel injection system. The magnitude of the oscillation was dependent upon the open loop gain (K) of the system. The transient response time of the system was also dependent on this gain.

These two factors are diametrically opposed since a large gain will result in a fast response time but will also cause a large amplitude limit cycle while a small gain will reduce the limit cycle amplitude but system response time will be sluggish. It is therefore an object of the present invention to provide a closed loop control for an internal combustion engine, responsive to a signal indicative of the quality of the combustion process occurring within the engine and operative to maintain the quality of the combustion process at or near a desired level by exhibiting a fast response time to deviations in the quality of the combustion process while maintaining the quality of the combustion process near the desired level by exhibiting a lower limit cycle amplitude. In the application of this type of closed loop control system to an internal combustion engine as a means of controlling the amount of pollutants generated by the engine, fast response time is at a premium but the large amplitude limit cycle which accompanied a fast response time resulted in a prior art system which was constantly hunting, over a wide region, for the proper level of signal output. Thus, the system did not result in the degree of pollution control desired. It is therefore an object of the present invention to improve the above described system to reduce the amplitude of the limit cycle while retaining a fast response time. It is a further object of the present invention to provide a system with a fuel controller input signal having a "softened" nonlinearity.

SUMMARY OF THE PRESENT INVENTION

The present invention provides a fixed amplitude oscillatory stabilization signal to be applied at the summing point in order to controllably and programmably drive the comparator between its output signal limits to result in a controlled and slight oscillation of the fuel quantity delivered to the engine. By establishing an amplitude of the stabilization signal to be less than the expected or tolerable minimum difference between the set point level (for a square wave stabilization signal) and the oxygen sensor signal, and by further establishing the stabilization signal frequency to be slightly above the band pass frequency of the closed loop system, the closed loop system according to the present invention is capable of having a fast response time with a small limit cycle amplitude. The stabilization signal frequency may be the triggering frequency of an electronic fuel injection system having two groups of sequentially actuated injector valves. For stabilization waveshapes other than a square wave, such as a sinusoidal or a triangular waveshape, a variation equal to the expected or tolerable minimum difference between the set point level and the combustion quality sensor signal would, it is believed, produce the best operation while an amplitude less than one-half of the minimum expected or tolerable difference would it is believed, not be adequate in terms of the life of the system and decay in the difference between the signals over the life of the sensor.

BRIEF DESCRIPTION OF THE DRAWINGS

FIG. 1 illustrates the closed loop control system of the present invention in a block diagram.

FIG. 2 illustrates an electronic circuit which may comprise a portion of the block diagram of FIG. 1.

DETAILED DESCRIPTION OF THE PREFERRED EMBODIMENT

Figure 3:
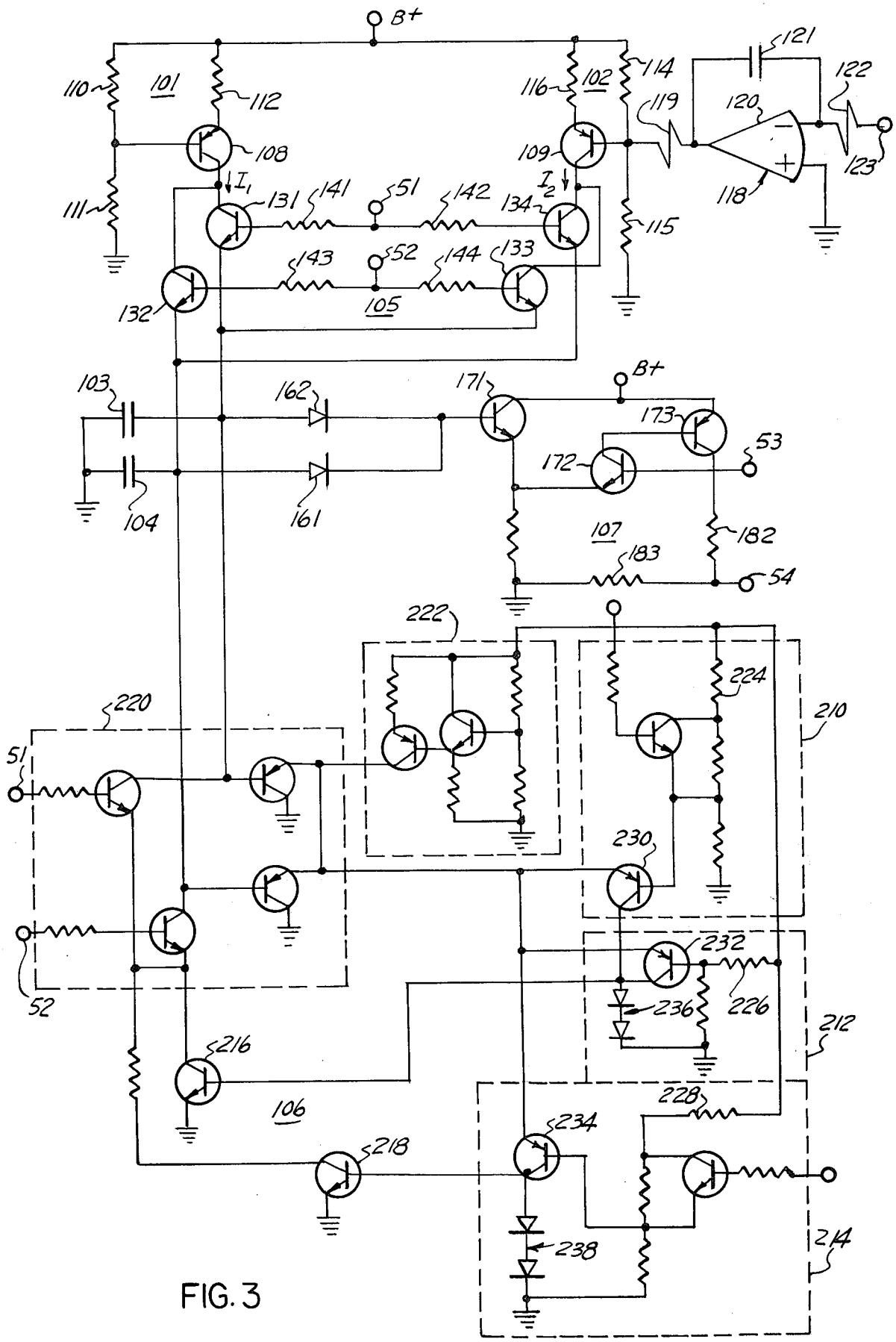
FIG. 3 illustrates an electronic circuit which may receive the output signal of the circuit of FIG. 2.

Referring now to FIG. 1, a block diagram of a closed loop control system according to the present invention and intended for association with a variable volume combustion chamber internal combustion engine 10 is illustrated. The engine 10 produces an exhaust gas stream through conduit 12 which stream is examined by an engine combustion quality sensor, in this case illustrated as exhaust sensor 20. The presently preferred embodiment contemplates an oxygen sensor operative to determine the percentage of oxygen concentration present within the exhaust gas stream. The output signal of the oxygen sensor is applied to a summing device 30 which also receives a fixed value signal, termed the set point value and according to the present invention a signal from oscillator 90, to be described hereinbelow. The output of the summing device 30 is then applied to comparator means 40 which generates an output signal having a first relatively low fixed value when the output of the oxygen sensor 20 exceeds the set point value and a second relatively high fixed value when the output of the oxygen sensor 20 is less than the set point value. This output signal is applied to the fuel delivery controller 50 to influence or modulate the amount of fuel being provided to the engine 10. The engine 10 receives various control inputs an illustrated at 60 which may be for example an air consumption controlling input in the form of a throttle setting (which may be operator controlled) as well as other inputs which may or may not be controlled such as the load placed upon the engine, ignition advance or retard signals or modulation of exhaust gas recirculation (EGR). The fuel delivery controller 50 also receives intelligence via communication link 70 which is indicative of the moment-to-moment operation of the engine. For example, in the known fuel injection systems, this intelligence may comprise information as to the speed of the engine, the temperature of the engine coolant, the density of the air being consumed by the engine, and such other input information as may be of use to the fuel delivery controller 50 in providing a gross fuel delivery control.

The summing point 30 also receives the oscillatory stabilization signal from oscillator 90 according to the present invention. The presently preferred form of this signal is a square wave signal but other waveforms, such as triangular and sinusoidal, are contemplated. The amplitude of the waveform generated by oscillator 90 should be selected to be approximately equal to the maximum deviation expected between the selected set point level (according to my above-noted co-pending application) and the output signal generated by sensor 20. The frequency of the signal should be slightly in excess of the closed loop bandpass frequency. Since the bandpass is a function of the engine performance, a first order approximation which has been found to be completely adequate in the case of a fuel injection system for a four cylinder engine having about 2,000 cubic centimeter displacement injecting in two out-of-phase cylinder groupings and is believed to represent a favorable frequency for other applications is the triggering frequency used by the fuel injection system. Thus, oscillator 90 may be a bistable multi-vibrator which is triggered by a trigger 91 in synchronism with the triggering of a fuel injection system providing discrete injection pulse to two groups of sequentially actuated injection valves.

The fuel delivery controller 50 would then control the quantity of fuel to be delivered to the engine through conduit 80 in accordance with these various sensed parameters. The closed loop control would be operative to modulate the gross fuel delivery control signal in accordance with a correction factor determined by oxygen sensor 20. In this manner, the system will automatically compensate for aging of the engine and other components associated therewith such as the fuel delivery mechanism, the EGR components, the engine valves and seals and any other components which would directly or indirectly effect the quantities of air and/or of fuel being measured, computed or delivered.

Referring now to FIG. 2, the summing device 30 and the comparator 40 are illustrated in a representative, and preferred, electronic embodiment. The summing device 30 is comprised of a plurality of interconnected resistors 32, 33, 34 with the resistor 34 arranged to receive the output signal from the exhaust sensor 20, resistor 32 arranged to receive a fixed value voltage signal from potentiometer 36, and resistor 33 arranged to receive the stabilizing signal from oscillator 90. Resistors 32, 33, 34 are interconnected at circuit node 38. Circuit node 38 communicates with one input to an operational amplifier 42. The other input to the operational amplifier 42 is communicated to a fixed voltage reference which represents the set point value. A parallel pair of oppositely directed diodes 44, 45 provide a feedback path around the operational amplifier 42 to establish maximum and minimum output signal levels. In the illustrated embodiment the fixed voltage reference is established by communicating a nonregulated source of voltage B+ through a resistance 41 to the cathode of a zener diode 43, the anode of which is connected to ground. This source of regulated voltage is also applied to the potentiometer 36, the slides of which is connected the summing device 30 and to the oxygen sensor to establish a reference voltage or middle ground at the oxygen sensor. This will permit the oxygen sensor to generate an output signal which is reference to the middle ground value so that, in the application of the present invention to an automotive vehicle which uses a d.c. supply with chassis ground (positive or negative) an intermediate voltage value will be used by the oxygen sensor as its "ground" in order to provide both positive and negative voltage values (relative to the middle ground) for the amplifier 42. The potentiometer 36 should be adjusted so that in the absence of a signal from oscillator 90, circuit node 38 will be at a voltage value equivalent to the reference voltage established by zener diode 43, the set point value, when the output from the oxygen sensor 20 is at the transitional value. That is, the set point value should be selected to correspond to the selected transitional value of the exhaust sensor. Alternatively, a voltage divider may be used in place of potentiometer 36 where adjustability is not required.

Figure 4:
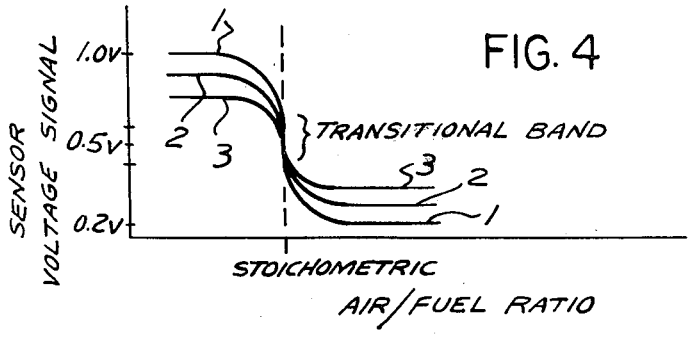
FIG. 4 illustrates various voltage signal waveforms which may be produced by the oxygen sensor of FIG. 1 in response to variations in sensor temperature and/or age.

With reference to FIG. 4, a graph is shown illustrating the output signal characteristic of the typical oxygen sensor with three output signal characteristic curves shown demonstrating a high to low excursion at the stoichiometric air/fuel mixture ratio. The curve identified as 1 corresponds to the maximum output signal excursion which would be produced by a new sensor operating at its maximum operating temperature. Curves 2 and 3 are illustrative of the output signal characteristic evidenced by an oxygen sensor operating at successively cooler temperatures or which is successively older. The signal curve 1 evidences a maximum excursion which, by way of example, would go from an output signal value of approximately 1.0 volts to an output signal value of 0.2 volts for increasing air fuel ratio with the excursion occurring substantially at the stoichiometric mixture ratio. Extreme aging of the device or operation of the device at a temperature far below its normal operating temperature will result in a minimal signal excursion of about ±0.2 volts. In the case of the sensor whose output signal characteristics are here illustrated, the signal characteristics of the curves 1, 2, and 3 overlap for a narrow region of output signal (of about 0.05 volts) centered at a value of about 0.5 volts as the various signals demonstrate their excursion characteristic. The "transitional band" for this sensor is thus about 0.05 volts wide and nominal value of 0.5 volts may be selected at the representative "transitional value". For illustrative purposes, the transitional band has been shown expanded. The set point value has been selected to correspond to the representative transitional value of 0.5 volts.

Figure 5:
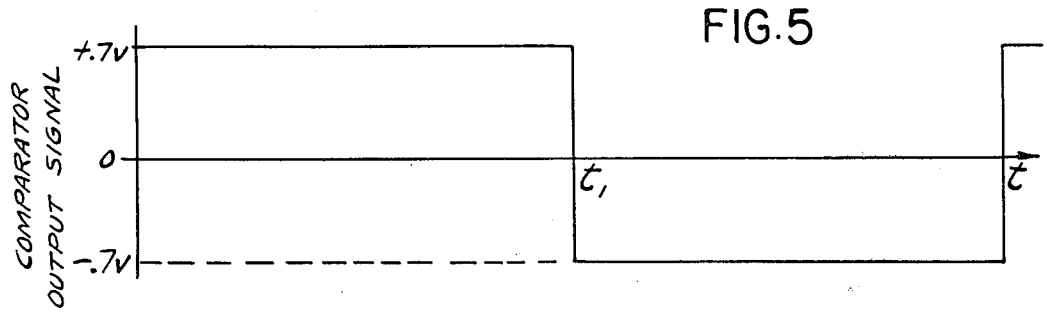
FIG. 5 illustrates representative voltage output signals generated by the comparator of FIG. 1 as a function of time for various oscillator output waveshapes.

With reference now to FIG. 5, is shown as a function of time for sensor means output signal which maintains a value substantially equal to the selected transitional value for the time interval illustrated and for an oscillatory stabilization signal of any waveshape according to the present invention. The influence of the oscillatory signal is dominant and is reflected in the time-base variations in comparator output signal which makes an excursion from +0.7 volts to −0.7 volts (with respect to the "middle ground") at time $t_1$ and which dwells for an equal amount of time at each level. For sensor signals indicative of major combustion quality deviations from the desired level, the output signal illustrated in FIG. 5 will be replaced by a constant value voltage signal, positive or negative with respect to the "middle ground" depending on the direction of the deviation (too rich or too lean). Minor deviations in combustion quality will result in a rectangular waveshape signal similar to that illustrated with average or effective correction signals applied as illustrated in FIG. 8 which illustrates effective correction signal as a function of error signal (oxygen sensor signal deviation from the set point value).

Figure 8:
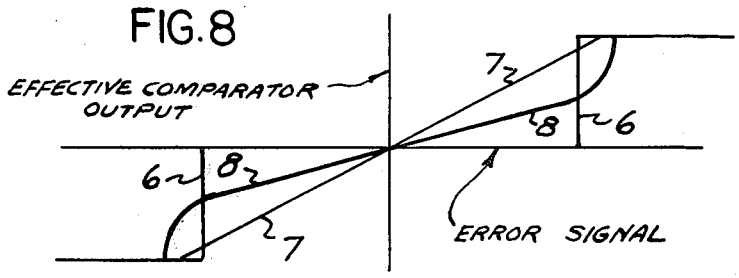
FIG. 8 illustrates the effective comparator output signal produced by the present invention as a function of the error signal for various stabilizer signal waveshapes over a time period of several cycles of the stabilizer signal.

Referring now to FIG. 8, the effective comparator output signal for varying error signals for square wave, sinusoidal wave and triangular wave stabilization signals is illustrated on a pair of orthogonal axes. Each curve is symetrical about the intersection of the axes. Curve 6 is the curve for a square wave stabilization signal and includes a horizontal segment interconnecting the vertical segments to which the lead lines for the numerals 6 are applied. Curve 7 is the curve for a triangular wave stabilization signal and curve 8 is the curve for a sinusoidal stabilization signal. Curves 6, 7, and 8 saturate at coincident maximal and minimal values corresponding to a comparator 40 output signal of +0.7 volt and −0.7 volt (respective to the "middle ground") corresponding to the particular values of the presently preferred embodiment. The error signal corresponding to the saturated values is illustrated as being different to clarify the figure and to point out that the error signal for differing stabilization signals may be different.

Referring now to FIG. 3, an electronic circuit is illustrated which accomplishes the general functions of the fuel delivery controller 50. The illustrated circuit includes a major portion of the electronic fuel injection computer according to co-pending commonly assigned patent application Ser. No. 226,498 filed on Feb. 15, 1972 in the name of J. N. Reddy and titled "Electronic Fuel Control System Including Electronic Means For Providing a Continuous Variable Correction Factor" expressly incorporated herein by reference, and is intended to be illustrative of one method for modulating fuel delivery in response to modulation commands of a closed loop control. The circuit of this figure is comprised of a pair of current sources 101, 102 which are alternately applied to a pair of timing capacitors 103, 104 by a switching network 105 receiving triggering signals at terminals 51, 52. Also receiving triggering signals at terminals 51, 52 (separately shown for convenience) network 106 controls the level of the voltage on the selected capacitor 103, 104 prior to generation of the injection command signal. Threshold establishing circuit means 107 samples the highest voltage appearing across capacitors 103, 104 and compares this value with the level established by the signal received at input port 53 to compute the fuel injection command signal. This signal may be derived by various known techniques such as illustrated in the co-pending Reddy application.

The current source 101 is comprised of transistor 108 whose base is connected to the junction of a pair of voltage dividing resistors 110, 111 and whose emitter is connected to resistor 112. The resistors 110 and 112 are connected to a source of potential identified as B+ and resistor 111 is connected to ground. Current source 102 is similarly comprised of a transistor 109 whose base is coupled to the junction of voltage divider resistors 114, 115 and whose emitter is connected to resistor 116 which is also connected to the B+ source. The base of transistor 109 is also connected to a modulating network 118 to be described hereinbelow. This arrangement is operative to establish readily calculable levels of current flow in the collectors of transistors 108, 109, respectively. The collector of transistor 108 is then connected a to the collectors of a pair of transistors 131, 132. Similarly, the collector of transistor 109 is connected to the collectors of a pair of transistors 133, 134. The bases of transistors 131 and 134 are connected together through resistances 141, 142 while the bases of transistors 132, 133 are connected by way of resistances 143, 144. The junction of resistances 141, 142 is connected to terminal 51 while the junction of resistances 143, 144 is connected to terminal 52. The emitters of transistors 131 and 133 are connected to capacitor 103 while the emitters of transistors 132 and 134 are connected to capacitor 104. The circuit is arranged to provide the current flow from current source 101 through transistor 131 to capacitor 103 and the current from source 102 through transistor 134 to capacitor 104 whenever a high voltage signal appears at terminal 51 and a low voltage signal appears at terminal 52. Whenever a low voltage signal is present at terminal 51 and a high voltage signal is present at terminal 52, the current from source 101 will flow through transistor 132 to capacitor 104, while the current from source 102 flows through transistor 133 to capacitor 103.

Figure 7:
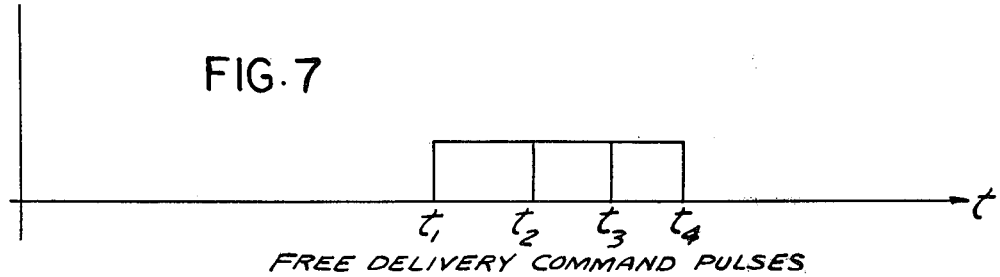
FIG. 7 illustrates the output signal generated by the circuit of FIG. 3 in response to the voltage waveforms of FIG. 6.

The threshold establishing circuit receives a signal indicative of, for example, an engine operating parameter such as the manifold pressure at terminal 53 and this signal is applied to the base of transistor 172. The base of transistor 171 receives, by way of diodes 161, 162, the signal from the one of capacitors 103, 104 whose accumulated charge, or voltage, is highest. As the emitters of transistors 171, 172 are coupled together, one of these transistors will be in conduction depending upon which has a base residing at a higher voltage value. When the value appearing on the base of transistor 171 exceeds the value appearing on circuit input 53, transistor 171 will go into conduction and transistor 172 will drop out of conduction. Termination of conduction of transistor 172 will consequently terminate conduction of transistor 173. While transistor 172 was conducting, transistor 173 was also conducting and a relatively high voltage signal, as illustrated in FIG. 7, was present at terminal 54 due to the voltage divider action of resistors 182, 183. However, termination of conduction of transistor 173 will result in a substantially zero or ground level signal appearing at circuit location 54 due to the lack of current flow through the resistors 182, 183. This output signal may be applied to any of the known injector valve driver circuits one of which is illustrated in Ser. No. 130.349—Junuthula N. Reddy—"Control Means For Controlling The Energy Provided To The Injector Valves Of An Electronically Controlled Fuel System" to constitute an injection command signal such application being expressly incorporated herein by reference.

The timing capacitor discharging and initial charge controlling circuitry 106 is comprised of a plurality of reference level establishing means 210, 212, and 214, a pair of discharging means 216, 218, switching means 220 and a current source means 222. The reference level establishing means 210, 212, and 214 are connected to the source of energy indicated as B+ and are comprised of voltage divider means 224, 226, and 228, respectively, and voltage signal communicating transistor means 230, 232, and 234 respectively. The voltage communicating transistor means 230, 232 and 234 are arranged to have their bases communicated to a portion of the voltage divider means so that a known level of voltage may appear thereon and their emitters are connected to a common point. The collectors of the transistors 230 and 232 are coupled together and are communicated to ground through a diode means 236 while the collector of transistor 234 is communicated to ground through a separate diode means 238. The collector/diode junction of the transistors 230, 232 and diode means 236 is communicated to the discharging means 216 while the collector/diode junction of transistor 234 and diode means 238 is communicated to the discharging means 218.

Figure 6:
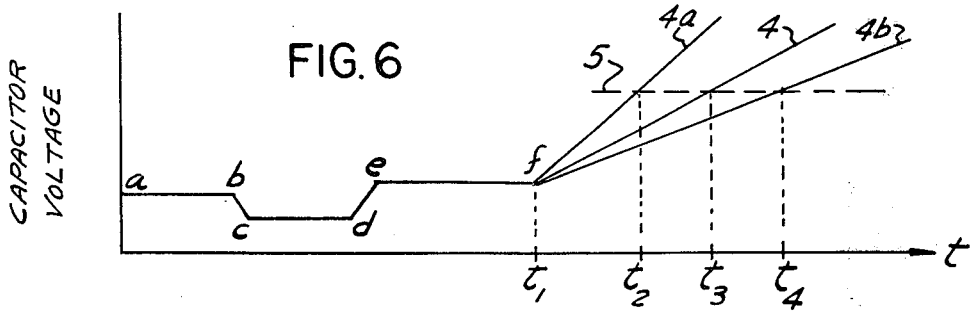
FIG. 6 illustrates a full cycle of the voltage waveform as a function of time generated by the circuit of FIG. 3 to control fuel delivery and includes two illustrative variations in waveform generated in response to the closed loop control of the present invention.

With reference to FIG. 6, a complete cycle of a voltage waveform on the capacitors 103, 104 is illustrated. The portion of the wave from a to f represent the voltage attributable to the current $I_1$ from source 101 while the portion identified as 4 represents the portion attributable to the current $I_2$ from source 102. The various level changes and slopes present in the $I_1$ initial portion of the waveform are attributable to the action of the reference level establishing means 210, 212, 214 and the charging and discharging characteristics of the capacitors under the influence of the current $I_1$ and the discharging means 106, 216, 218. A similar waveform 180 degrees out of phase with this waveform is generated on the other of the capacitors 103, 104 so that the initial points a and f of the first and second portions of the waveforms on the capacitors 103, 104 coincide in time and also coincide with the receipt of mutually exclusive triggering signals received on terminals 51, 52. Receipt of a relatively high signal at terminal 51 will result in a rapid dumping of the energy stored in capacitor 103 and the resultant application of current $I_1$ to the capacitor 103 to charge that capacitor. The voltage appearing on that capacitor as a result of the application of current $I_1$ and as modulated by the action of the reference level establishing means 210, 212 will result in a voltage waveform appearing on capacitor 103 substantially as shown in FIG. 6 from points a through b, c, d, e and to point f of the curve in FIG. 6. At the point in time corresponding to point f, the triggering inputs received at input terminals 51, 52, will be reversed so that capacitor 103 will receive the current $I_2$. The value of current $I_2$ will be a function of the voltage appearing on the base terminal of transistor 109 and will charge capacitor 103 as shown on the portion of the curve identified as 4 of FIG. 6. A representative threshold value is illustrated in FIG. 6 as the dashed line 5 and the second portion of the curve, 4, crosses the threshold 5 at a point in time identified as $T_3$. The circuit of FIG. 3 would therefore be operative to provide a flow of fuel to the engines in accordance with the teachings of the above-noted pending applications for the time period between $T_1$ and $T_3$.

With reference now to FIG. 3, modulating network or means 118 is illustrated as communicating with the base of transistor 109 through resistance 119. As illustrated, the modulating means 118 is comprised of an operational amplifier 120 having a capacitor 121 in its feedback loop communicating with the inverting input which also communicates through resistor 122 with a terminal 123. This terminal communicates directly with a similarly designated terminal of the comparator device 40 of FIGS. 1 and 2. Upon receipt of a comparator device output signal as illustrated in FIG. 5, the operational amplifier will be operative to generate at the base of transistor 109 an output voltage which will either be gradually increasing in the case of a negative input signal from comparator 40 or will be gradually decreasing in the case of a positive input from the comparator 40 or will be gradually decreasing in the case of a positive input from the comparator 40 so as to add or substract incremental units of base drive for transistor 109. This will result in increasing or decreasing the magnitude of the current $I_2$ and hence changing the slope of the ramp voltage generated at the capacitor 103, 104 receiving this current. Again with reference to FIG. 6, this will result in a curve identified as **4*b* for decreasing values of current $I_2$ and the curve 4*a* for increasing values of $I_2$. For convenience, the deviations between curves 4*a*, 4*b*, and 4 have been greatly exaggerated. With reference now to FIG. 7, the circuit of FIG. 3 and the curve 4*a* would generate a fuel injection command pulse having a duration from $T_1$ to $T_2$ while the curve 4 would generate a fuel injection command pulse having a duration from $T_1$ to $T_3$ and the curve 4*b* would generate the fuel injection command pulse subsisting from time $T_1$ to $T_4$. It can thus be seen, that for a given set of operating conditions for the engine, exemplified by the fact that threshold curve 5 in FIG. 4** is unchanging, the quantity of fuel delivered to the engine may be smoothly and rapidly varied by the closed loop control system of the present invention to maintain the air/fuel ratio at the predetermined value.

I claim:

1. A control system for an internal combustion engine said control system comprising:

an internal combustion engine;

sensor means for examining an engine operating variable, operative to generate an output signal having a variable characteristic selected to be indicative of the quality of the combustion process occurring within the engine;

signal generating means operative to generate an oscillatory signal having a frequency varying with engine RPM;

signalling means responsive to combine the sensor means signal and the oscillatory signal and to generate a further output signal, at least a portion of which has a repetition rate controlled by said frequency of said oscillatory signal and at least a portion of which has a signal characteristic dependant on said variable characteristic which is indicative of combustion process quality deviations from a predetermined quality;

fuel delivery controller means receiving said further output signal and operative to modulate each increment of fuel delivery at all engine speeds in response to both the repetition rate and characteristic of said further output signal.

2. A control system for an internal combustion engine said control system comprising:

an internal combustion engine;

sensor means for examining an engine operating variable, operative to generate an output signal having a variable characteristic selected to be indicative of the quality of the combustion process occurring within the engine;

signal generating means operative to generate an oscillatory signal having a frequency varying with engine RPM;

signalling means responsive to combine the sensor means signal and the oscillatory signal and to generate a further alternating output signal having a repetition rate controlled by said frequency of said oscillatory signal and having a signal characteristic dependent on said variable characteristic which is indicative of combustion process quality deviations from a predetermined quality;

fuel delivery controller means receiving said further output signal and operative to modulate each increment of fuel delivery at all engine speeds in response to both the repetition rate and characteristic of said further output signal, said signalling means comprising reference level establishing means, comparator means, and integrator means, said reference level establishing means operative to establish a set point level having a value in the range of values of said sensor means output signal, said comparator means providing an effective comparator output signal having first and second constant magnitudes when said sensor means output signal is respectively above and below first and second predetermined offsets from said set point level and said comparator output signal when said sensor means output signal is intermediate said predetermined offsets having a shape determined by the combination of said sensor means output signal and said oscillatory signal, and said integrator means generating said further output signal by integrating said effective comparator output signal.

3. The system as claimed in claim 1 wherein said variable frequency is selected to be substantially equal to the frequency at which the engine makes two complete revolutions.

4. The system as claimed in claim 1 wherein said signal generating means comprise trigger means providing a triggering frequency to a fuel delivery controller and said variable frequency is selected to be substantially equal to said triggering frequency.

5. In the combination with an internal combustion engine closed loop control system of the type having sensor means for examining the quality of the combustion process occurring with the engine, signalling means responsive to the sensor means signal and operative to generate a further output signal having a predetermined signal characteristic indicative of the sensor signal and controller means receiving said further output signal to modulate an engine control parameter in response to the further output signal, the improvement comprising:

stabilization signal generating means operative to generate an oscillatory output signal having a signal frequency varying with engine speed and a signal magnitude which is less than the expected minimum sensor means signal magnitude, and means for applying said oscillatory signal to the signalling means as a dithering signal to the signalling means as a function of engine speed for minimizing the closed loop response time and the closed loop limit cycle amplitude, 6. The system as claimed in claim 5 wherein said variable frequency is selected to be substantially equal to the frequency at which the engine makes two complete revolutions.

7. The system as claimed in claim 5 wherein said signalling means comprise trigger means providing a triggering frequency to a fuel delivery controller and said variable frequency is selected to be substantially equal to said triggering frequency.

8. Exhaust gas composition control system for internal combustion engines having sensing means sensing the composition of exhaust gases from the engine;

an integral controller integrating the sensed signal with respect to time and providing an output control signal;

means mixing and proportioning the air and fuel being applied to the engine, said output control signal from the integral controller being connected and applied to said proportioning means and controlling said mixing and proportioning means to mix the air-fuel mass ratio which results in a predetermined exhaust gas composition as sensed by said sensor when the mixture is burned in the engine;

the improvement wherein the integral controller integrates in steps, or recurring pulses, or cycles;

and means are provided deriving a pulsed signal representative of engine speed, said pulsed speed signal being applied to said integral controller to control the rate of cyclical recurrence of integration steps thereof in dependence on engine speed to effect integration as a function of said speed signal.

9. Exhaust gas composition control system for internal combustion engines having sensing means sensing the composition of exhaust gases from the engine;

an integral controller integrating the sensed signal with respect to time and providing an output control signal;

means mixing and proportioning the air and fuel being applied to the engine, said output control signal from the integral controller being connected and applied to said proportioning means and controlling said mixing and proportioning means to mix the air-fuel mass ratio which results in a predetermined exhaust gas composition as sensed by said sensor when the mixture is burned in the engine;

the improvement wherein the integral controller integrates in steps, or recurring pulses, or cycles;

means are provided deriving a pulsed signal representative of engine speed, said pulsed speed signal being applied to said integral controller to control the rate of cyclical recurrence of integration steps thereof in dependence on engine speed to effect integration as a function of said speed signal, a threshold switch connected to the output of the exhaust gas sensing means and providing on-off sensing output signals when the sensed exhaust gas signal passes a pre-set limit;

and a switching circuit controlled by said engine speed signal, the on-off sensing signal being connected to said integral controller through said switching circuit and being further modified by said switching circuit in accordance with the speed of the engine.

10. Method of controlling the composition of the exhaust gases of an internal combustion engine which comprises the steps of mixing air and fuel to prepare an air-fuel mixture for application to the engine;

sensing engine speed;

sensing exhaust gas composition and deriving a sensing signal representative of said composition;

controlling the relative proportion of air and fuel being mixed as a function of (a) exhaust gas composition, (b) time, (c) engine speed; wherein said controlling step comprises integrating the sensed signal in cyclically repetitive steps and controlling the recurrence rate of said repetitive steps, as a function of engine speed.

11. Exhaust gas composition control system for internal combustion engines having sensing means sensing the composition of exhaust gases from the engine;

an integral controller integrating the sensed signal with respect to time and providing an output control signal;

means mixing and proportioning the air and fuel being applied to the engine, said output control signal from the integral controller being connected and applied to said proportioning means and controlling said mixing and proportioning means to mix the air-fuel mass ratio which results in a predetermined exhaust gas composition as sensed by said sensor when the mixture is burned in the engine;

the improvement wherein the integral controller integrates in steps, or recurring pulses, or cycles;

and means are provided deriving a pulsed signal representative of engine speed, said pulsed speed signal being applied to said integral controller to control the rate of cyclical recurrence of integration steps thereof in dependence on engine speed to effect integration as a function of said speed signal, wherein said integral controller has a fixed integration rate.

12. Exhaust gas composition control system for internal combustion engines having sensing means sensing the composition of exhaust gases from the engine;

an integral controller integrating the sensed signal with respect to time and providing an output control signal;

means mixing and proportioning the air and fuel being applied to the engine, said output control signal from the integral controller being connected and applied to said proportioning means and controlling said mixing and proportioning means to mix the air-fuel mass ratio which results in a predetermined exhaust gas composition as sensed by said sensor when the mixture is burned in the engine;

the improvement wherein the integral controller integrates in steps, or recurring pulses, or cycles;

and means are provided deriving a pulsed signal representative of engine speed, said pulsed speed signal being applied to said integral controller to control the rate of cyclical recurrence of integration steps thereof in dependence on engine speed to effect integration as a function of said speed signal, wherein said integral controller has a predetermined integration rate;

said pulsed speed signal is a pulsed on-off signal having an on-off ratio which is dependent on speed; and said integral controller is controlled by the ON pulses of said speed signal to effect integration at it predetermined rate during the ON-pulses only.

13. Method of controlling the composition of the exhaust gases of an internal combustion engine which comprises the steps of mixing air and fuel to prepare an air-fuel mixture for application to the engine;

sensing engine speed;

sensing exhaust gas composition and deriving a sensing signal representative of said composition;

controlling the relative proportion of air and fuel being mixed as a function of (a) exhaust gas composition, (b) time, (c) engine speed; wherein said controlling step comprises integrating the sensed signal in cyclically repetitive steps and controlling the recurrence rate of said repetitive steps, as a function of engine speed, wherein the step of integrating the sensed signal in cyclically repetitive steps comprises periodically integrating said sensed signal at a fixed integration rate.

14. Method of controlling the composition of the exhaust gases of an internal combustion engine which comprises the steps of mixing air and fuel to prepare an air-fuel mixture for application to the engine;

sensing engine speed;

sensing exhaust gas composition and deriving a sensing signal representative of said composition;

controlling the relative proportion of air and fuel being mixed as a function of (a) exhaust gas composition, (b) time, (c) engine speed; wherein said controlling step comprises integrating the sensed signal in cyclically repetitive steps and controlling the recurrence rate of said repetitive steps, as a function of engine speed, wherein the step of controlling the recurrence rate of said repetitive steps includes controlling the duration of interruption of integration, between steps, as a function of engine speed.

15. Method of controlling the composition of the exhaust gases of an internal combustion engine which comprises the steps of mixing air and fuel to prepare an air-fuel mixture for application to the engine;

sensing engine speed;

sensing exhaust gas composition and deriving a sensing signal representative of said composition;

controlling the relative proportion of air and fuel being mixed as a function of (a) exhaust gas composition, (b) time, (c) engine speed; wherein said controlling step comprises integrating the sensed signal in cyclically repetitive steps and controlling the recurrence rate of said repetitive steps, as a function of engine speed, wherein the step of controlling the recurrence rate of said repetitive steps comprises pulsing the sensing signal as a function of engine speed, and the integration step comprises integrating the pulsed signal.

16. Exhaust gas composition control system for internal combustion engines having sensing means sensing the composition of exhaust gases from the engine;

an integral controller integrating the sensed signal with respect to time and providing an output control signal;

means mixing and proportioning the air and fuel being applied to the engine, said output control signal from the integral controller being connected and applied to said proportioning means and controlling said mixing and proportioning means to mix the air-fuel mass ratio which results in a predetermined exhaust gas composition as sensed by said sensor when the mixture is burned in the engine;

the improvement wherein the integral controller integrates in steps, or recurring pulses, or cycles;

means are provided deriving a pulsed signal representative of engine speed, said pulsed speed signal being applied to said integral controller to control the rate of cyclical recurrence of integration steps thereof in dependence on engine speed as a function of said speed signal;

a threshold switch connected to the output of the exhaust gas sensing means and providing on-off sensing output signals when the sensed exhaust gas signal passes a pre-set limit;

a switching circuit controlled by said engine speed signal, the on-off sensing signal being connected to said integral controller through said switching circuit and being further modified by said switching circuit in accordance with the speed of the engine, and a multivibrator controlled by said engine speed signal and providing output pulses at a rate representative of engine speed to form said pulsed speed signal;

said output pulses being connected to said switching circuit to interrupt the on-off sensing signal being applied to said integral controller and command the integral controller to integrate the sensing signal only during occurrence of the output pulses from the multivibrator.

17. System according to claim 16 wherein the integration rate of the integral controller is fixed and the duration of integration per unit time is controlled by the number of output pulses per unit time.

18. System according to claim 16 wherein the mixing and proportioning means comprises a fuel injection system, said system including said means deriving the engine speed representative signal to control the integration time of the integral controller in accordance with the repetition rate of fuel injection events of the fuel injection system.

19. Method of controlling the composition of the exhaust gases of an internal combustion engine which comprises the steps of:

mixing air and fuel to prepare an air-fuel mixture for application to the engine;

sensing engine speed;

sensing exhaust gas composition and deriving a sensing signal representative of said composition;

controlling the relative proportion of air and fuel being mixed as a function of (a) exhaust gas composition, (b) time, (c) engine speed; wherein said controlling step comprises integrating the sensed signal in cyclically repetitive steps and controlling the recurrence rate of said repetitive steps, as a function of engine speed;

pulsing the sensing signal comprises periodically sampling the sensing signal at a rate representative of engine speed, and the integrating step comprises integrating the sampled signal with respect to time, at a fixed rate, during said sampling periods.

* * * * *